US006560816B1

(12) United States Patent
Harrelson, II

(10) Patent No.: US 6,560,816 B1
(45) **Date of Patent: *May 13, 2003**

(54) CENTRAL VACUUM SYSTEM WITH BAG MOUNTING ASSEMBLY

(75) Inventor: Clyde W. Harrelson, II, Burgaw, NC (US)

(73) Assignee: Vacs America, Inc., Burgaw, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/810,860

(22) Filed: Mar. 16, 2001

Related U.S. Application Data

(63) Continuation-in-part of application No. 09/773,827, filed on Jan. 31, 2001.

(51) Int. Cl.[7] ..... A47L 5/38

(52) U.S. Cl. ..... 15/314; 15/315; 15/323; 15/352; 55/DIG. 3

(58) Field of Search ..... 15/347, 350, 352, 15/314, 323, 315; 55/DIG. 3, 369, 373, 478

(56) References Cited

U.S. PATENT DOCUMENTS

| | | | | | |
|---|---|---|---|---|---|
| 3,023,447 | A | | 3/1962 | Senne | |
| 3,066,345 | A | * | 12/1962 | Kasper | 55/478 |
| 3,213,480 | A | | 10/1965 | Miller | |
| 3,422,482 | A | | 1/1969 | Hamrick | |
| 3,568,239 | A | | 3/1971 | Hamrick | |
| 3,593,363 | A | * | 7/1971 | Hamrick | 15/315 |
| 3,706,184 | A | | 12/1972 | Tucker | |
| 3,714,765 | A | | 2/1973 | Simonelli | |
| 4,452,618 | A | * | 6/1984 | Kuplas | 15/323 |
| 4,670,937 | A | | 6/1987 | Summerau et al. | |
| 4,678,486 | A | | 7/1987 | Jacob et al. | |
| 4,688,292 | A | * | 8/1987 | Schmiegel | 15/315 |
| 4,699,641 | A | * | 10/1987 | Barnes, Jr. | 15/352 |
| 4,885,013 | A | | 12/1989 | Ahlf et al. | |
| 5,020,186 | A | * | 6/1991 | Lessig et al. | 15/339 |
| 5,028,245 | A | * | 7/1991 | Stein et al. | 15/350 |
| 5,083,704 | A | * | 1/1992 | Rounthwaite | 15/314 |
| 5,089,038 | A | | 2/1992 | Kopco et al. | |
| 5,221,303 | A | | 6/1993 | Guhne et al. | |
| 5,544,385 | A | | 8/1996 | Jailor et al. | |
| 5,740,581 | A | * | 4/1998 | Harrelson, II | 15/314 |
| 5,740,582 | A | * | 4/1998 | Harrelson, II | 15/314 |
| 5,755,009 | A | | 5/1998 | Stephens et al. | |
| 5,935,280 | A | | 8/1999 | Lee | |
| 5,970,575 | A | * | 10/1999 | Lee | 15/352 |
| 6,158,080 | A | | 12/2000 | Schlapkohl | |
| 6,427,284 | B1 | * | 8/2002 | Harrelson, II et al. | 15/315 |

* cited by examiner

*Primary Examiner*—Theresa T. Snider
(74) *Attorney, Agent, or Firm*—MacCord Mason PLLC

(57) ABSTRACT

A central vacuum cleaner system is mounted within the wall of a building and includes an in wall mounted enclosure. The enclosure has a front door moveable between open and closed positions, and a vacuum cleaner bag holder in the enclosure moveable between closed and open positions, so that the door engages the holder when the door is moved from the open to the closed position, thereby moving the bag holder from its open to its closed position. A conduit extends from at least one remotely located hose inlet connector to a distal end within the enclosure, with the distal end being inserted into a bag carried by the bag holder when the bag holder is moved to the closed position. A vacuum source, preferably within the enclosure, is adapted to draw air from the inlet connector into the enclosure.

14 Claims, 6 Drawing Sheets

CENTRAL VACUUM SYSTEM WITH BAG MOUNTING ASSEMBLY

This application is a continuation-in-part of U.S. patent application Ser. No. 09/773,827, filed Jan. 31, 2001.

BACKGROUND OF THE INVENTION (1) Field of the Invention

The present invention relates generally to an assembly for holding a disposable bag in an in-wall or other stationary vacuum cleaner, and in particular to a vacuum cleaner bag mounting assembly forming a part of a stationary vacuum cleaner that facilitates attachment and removal of disposable vacuum cleaner bags.

(2) Description of the Prior Art

Vacuum cleaners used to remove debris within a house or other building are generally comprised of a flexible hose with a distal inlet end and a proximal outlet end, a vacuum source to draw air through the hose, and a debris collector interposed between the hose and the vacuum source to collect debris carried in the air exiting from the hose outlet end. Vacuum cleaners have historically been of two designs. So-called portable vacuum cleaners are designed to be carried or rolled about the area to be vacuumed, and usually include a bag or canister to enclose an air permeable, disposable bag designed to be removably attached to the outlet end of a conduit that is in communication with a flexible hose or other debris collection device.

Stationary or central vacuum cleaners are generally comprised of a vacuum source and debris collector installed in a remote location within the building, with conduits extending from the remote location to various areas requiring vacuuming. When used, a flexible hose is attached to one of the outlets and the vacuum source to draw air and any collected debris through the flexible hose and conduit. The air is then conveyed through the debris collector for removal of debris before the air is discharged to the exterior.

More recent innovations include the development of in-wall or free standing vacuum cleaners such as described in U.S. Pat. Nos. 5,740,581 and 5,740,582 to Harrelson, II, both issued Apr. 21, 1998, assigned to the assignee of this invention, and incorporated herein by reference. These patents describe an in-wall system with a cabinet having one compartment to enclose a vacuum unit and a debris collector, and a hose storage compartment that includes a reversible drive unit for extending and retracting the hose. The upper area of the cabinet includes a door for access to a hose nozzle connected to the distal end of the flexible hose, which has its proximal end connected to the vacuum unit. Another door in the lower part of the cabinet provides access to the debris collector. The cabinet is sized to fit between adjacent wall studs.

When using the device described in the Harrelson, II patents, the user opens the door in the upper part of the cabinet and grasps the hose nozzle, which includes a switch with forward-stop-reverse positions in circuit with the drive unit. The drive unit includes drive rollers that exert pressure on either side of the hose, which extends from its storage compartment between the nip of the drive rollers. When the user moves the switch to the "forward" position, the drive rollers turn to feed the hose outwardly from the cabinet until all of the hose has been extended, or until the switch is moved to the "off" position by the user. After vacuuming, the user moves the switch to "reverse", rotating the rollers in the opposite direction to return the hose to the storage compartment.

The debris collector is comprised of an open-front enclosure with a conduit in communication with the proximal end of the flexible hose extending into the enclosure, The enclosure is also in communication with a vacuum source, which can be within the enclosure, or in communication with the enclosure through a discharge opening in the enclosure wall. A hinged door provides access into the enclosure and forms an airtight seal with the front edges of the enclosure when closed.

The enclosure is sized to receive a disposable vacuum cleaner bag of the type sold for use with portable vacuum cleaners. Generally, these bags are comprised of a bag portion formed of paper or other flexible, air permeable material, and a cover that extends across the bag mouth. The cover includes a conduit opening for receiving the hose conduit. A flexible, annular ring having a diameter slightly less than the diameter of the hose conduit normally surrounds the periphery of the conduit opening to provide a sealing fit with the exterior surface of the hose conduit.

To install a disposable bag, the user opens the door, inserts a bag into the enclosure and pushes bag cover opening around the hose conduit. After the door is closed, the vacuum source can be activated, drawing air from the hose conduit through the bag and out of the enclosure, with any airborne debris being captured in the bag interior. To remove a full bag, the user opens the door and pulls the bag from the hose conduit.

Due to its in-wall placement, the dimensions of the bag enclosure closely approximate the outer dimensions of the flexible bag. In addition, the door providing access into the bag enclosure is often located close to the floor. As a result, placement of the bag can be cumbersome and time consuming. In addition, there is a risk that the bag may not be accurately attached to the conduit, or that the bag may be torn when being removed from the conduit, in either instance resulting in debris spillage. Therefore, a better way to attach and remove the disposable bag would be of great value, and would increase the utility of in-wall and other stationary vacuum cleaners.

SUMMARY OF THE INVENTION

The present invention addresses this need by providing an improved vacuum cleaner bag mounting assembly, and an in-wall vacuum cleaner that incorporates this assembly. Generally, the assembly is comprised of an open-front enclosure with a rear wall and opposed side walls, a top wall and a bottom wall, and a bag holder pivotal within the enclosure between open and closed positions. A hose conduit extends into the enclosure through either the top wall or one of the side walls, the wall through which the conduit extends being referred to herein as the enclosure conduit wall. The assembly also includes a hinged door positionable across the front opening of the enclosure.

The bag holder is adapted to support a disposable bag so that pivoting of the bag holder to the closed position inserts the bag opening over the end of the hose conduit. For example, the holder can include an conduit attachment wall with a hose conduit access opening, and means for attaching a disposable bag beneath the conduit attachment wall so that the bag opening is aligned with the conduit access opening. The conduit attachment wall may be a plate with inner and outer surfaces, with a conduit receiving opening extending between the surfaces.

The conduit attachment wall or plate is hinged at its front edge to the front edge of the enclosure conduit wall. Thus, when the bag holder is in the closed position, the bag attachment wall of the bag holder is parallel to the enclosure conduit wall. When the bag is to be removed, or another bag inserted, the bag holder is pivoted to the open position, which moves the bag opens from contact with the hose conduit. After a bag has been positioned onto the bag holder, the holder is pivoted to the closed position, which pushes the bag opening around the hose conduit.

Preferably, the bag holder also includes side walls to prevent a bag carried in the bag holder from scrubbing against the enclosure when being inserted or removed. The holder may also include bottom and rear walls. One or more of these walls may be perforated to provide unobstructed airflow.

The inner faces of the side walls may be separated at a distance slightly greater that the width of the disposable bag that is to be mounted in the holder, and may include opposed slots parallel to, and spaced slightly below, the attachment plate for slidably receiving the side edges of the bag cover. Partial walls are also contemplated by the invention, as are discontinuous slots.

The enclosure door is desirably hinged to the front edge of the enclosure that is on the opposite side from the front edge to which the attachment plate is hinged. For example, the attachment plate may be hinged to the top front edge of the enclosure, with the door being hinged to the bottom front edge of the enclosure. Alternatively, the enclosure conduit wall can form one of the side walls of the enclosure, with the enclosure door being hinged to the front edge of the opposite side wall.

The bag holder can be moved manually between the open and closed positions, by grasping the holder and pulling or pushing, as the case may be. However, in accordance with the present invention, the device can also include a spring to urge the bag holder to the open position, with the enclosure door moving the bag holder to the closed position, and holding the holder in the closed position, when the door is closed.

For example, the bag holder can be designed so that at least a part of the bag holder engages the inner surface of the door when the bag holder is in the closed position and the door is closed. If the hinge is at the front edge of the enclosure, then a part of the lower front edge, e.g., the front lower corners of the side walls, can be vertically beneath the hinge when the bag attachment wall is parallel to the enclosure conduit wall. In this position, the lower front edge of the bag holder will be restrained from outward movement by the closed door, thereby holding the attachment wall parallel to the conduit wall.

When the door is opened, a part of the front edge of the bag holder is allowed to pivot forward, moving the attachment wall away from the conduit wall, and separating the disposable bag from the hose conduit. Outward movement of the lower edge of the bag holder is facilitated by the use of a spring that is attached to the bag older to urge the bag holder in an outward direction. For example, a spring may be positioned between the attachment wall and the conduit wall, with the spring being compressed when the bag holder is moved to the closed position.

For example, the bag holder can be designed so that at least a part of the bag holder engages the inner surface of the door when the bag holder is in the closed position and the door is closed. If the hinge is at the front edge of the enclosure, then a part of the lower front edge, e.g., the front lower corners of the side walls, can be vertically beneath the hinge when the bag attachment wall is parallel to the enclosure conduit wall. In this position, the lower front edge of the bag holder will be restrained from outward movement by the closed door, thereby holding the attachment wall parallel to the conduit wall. When the door is opened, the lower edge of the bag holder is allowed to pivot forward, moving the attachment wall away from the conduit wall, and separating the disposable bag from the hose conduit.

In operation, the user opens the enclosure door, which permits the bag holder to pivot to the open position. A bag is inserted into the bag holder, with the top of the bag being secured along the bag attachment wall. The enclosure door is then closed. As the door is closed, the inner surface of the door contacts a front section, e.g., the front lower edge, of the bag holder, pushing the bag holder to the closed position. As the bag holder is moved to the closed position, the mouth or opening of the bag is pushed around the hose conduit, with the flexible member creating a seal with the outer surface of the conduit. Latching of the door holds the bag holder in the closed position.

When the bag is full, the user simply opens the enclosure door. The bag holder, no longer held in the closed position, is urged to the open position by the spring. As the bag holder moves to the open position, the bag mouth is pulled away from the hose conduit. Thus, when the bag holder is in the open position, the user can simply lift the full bag from the holder without danger of spillage.

As illustrated and described in the Detailed Description of The Invention, the foregoing bag mounting assembly can be used as a component of various stationary vacuum cleaners, such as in-wall vacuum cleaners such as the Harrelson, II in-wall vacuum cleaners, or as part of conventional central vacuum cleaners comprised of connected conduits that extend, normally within building walls, to hose inlet connections positioned at various locations within the building.

For this latter use, the assembly inlet will be in communication with the conduits to draw air through an inlet, and through the conduit into the bag supported within the assembly. An exhaust conduit will also extend from the assembly, normally adjacent the vacuum source, to convey exhaust air from the assembly to an exhaust outlet, which will normally be located on the exterior of the building.

BRIEF DESCRIPTION OF THE DRAWINGS

The following drawings are for the purpose of illustrating the invention and are not intended to be to scale.

DETAILED DESCRIPTION OF THE INVENTION

Figure 1:
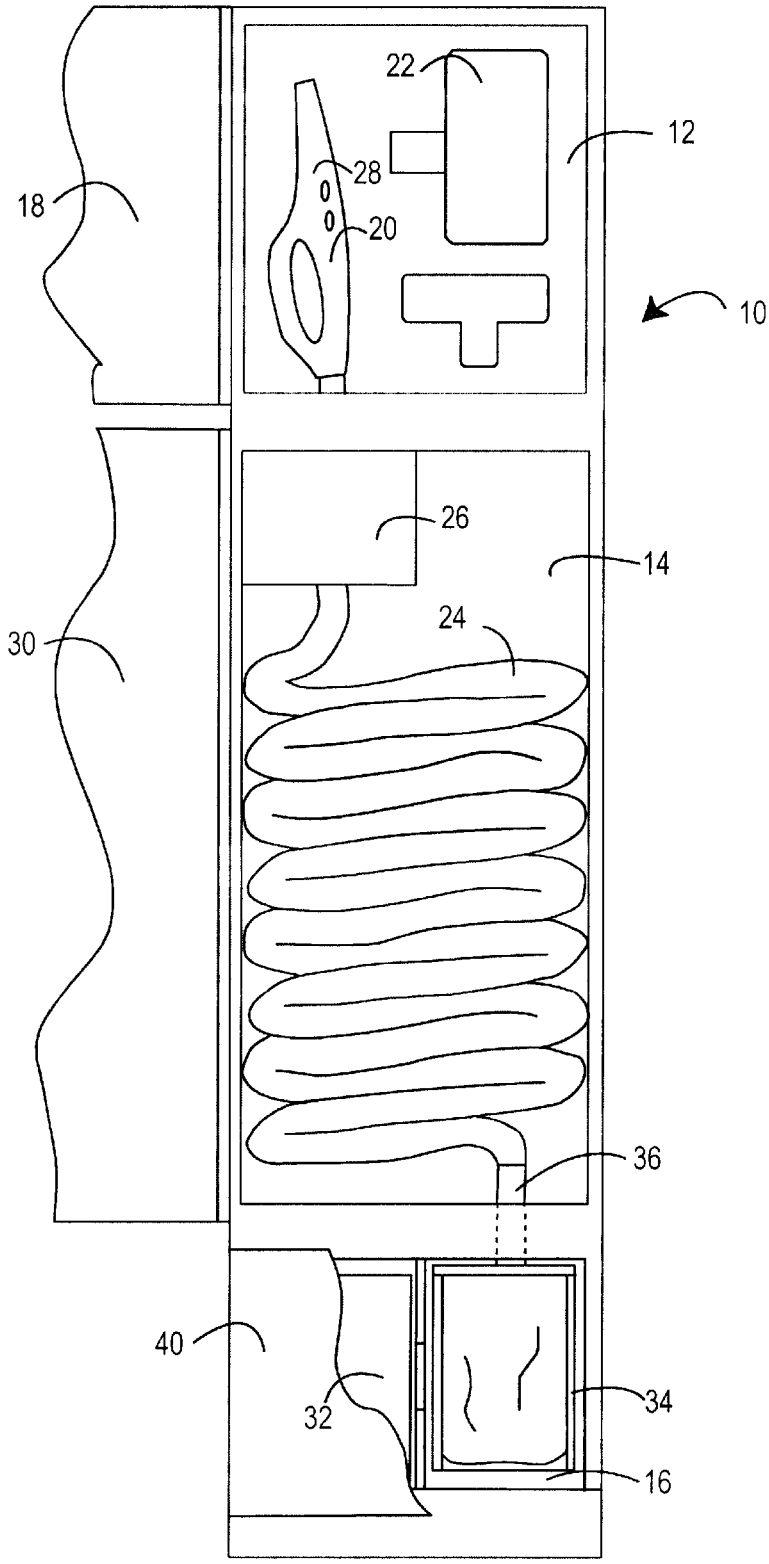
FIG. 1 is a perspective front view of an in-wall vacuum cleaner with the upper door opened to show the interior of the hose and hose accessory compartments, and a part of the door over the vacuum clean bag and vacuum source compartments cut away.

FIG. 1 illustrates one embodiment of an in-wall vacuum cleaner, generally 10, that includes the vacuum cleaner bag holder assembly of the present invention. It will be understood that the assembly can be used with other stationary vacuum cleaners, and that its use with an in-wall vacuum cleaner is for the purpose of illustration. Vacuum cleaner 10 includes an upper or attachment compartment 12, a middle or hose storage compartment 14, and a lower or vacuum source compartment 16.

Attachment compartment 12, covered by a hinged door 18, is adapted to store the handle 20 and a plurality of attachments 22 for convenient access by the user. Handle 20 is attached to the distal end of hose 24 that is stored in hose storage compartment 14. Hose 24 extends through a reversible drive 26 that is controlled by switches 28 on handle 20, and is adapted to extend and retract hose 24 from compartment 14. Hose storage compartment 14 is covered by hinged door 30.

Lower or vacuum source compartment 16 houses a vacuum source 32, which may be an electric motor with a suction fan, and vacuum bag holder 34 in communication with vacuum source 32 through opening 33. Hose conduit 36 extends between hose storage compartment 14 into vacuum source compartment 16. The end of hose conduit 36 within compartment 14 is attached to the proximal end of hose 24, while the other end of conduit 36 projects inwardly to a free end within compartment 16 through top or conduit connector wall 38. It will be understood that in other embodiments, conduit connector wall 38 may serve as a side wall of compartment 16, instead of the top wall. Compartment 16 is covered by hinged door 40.

Figure 2:
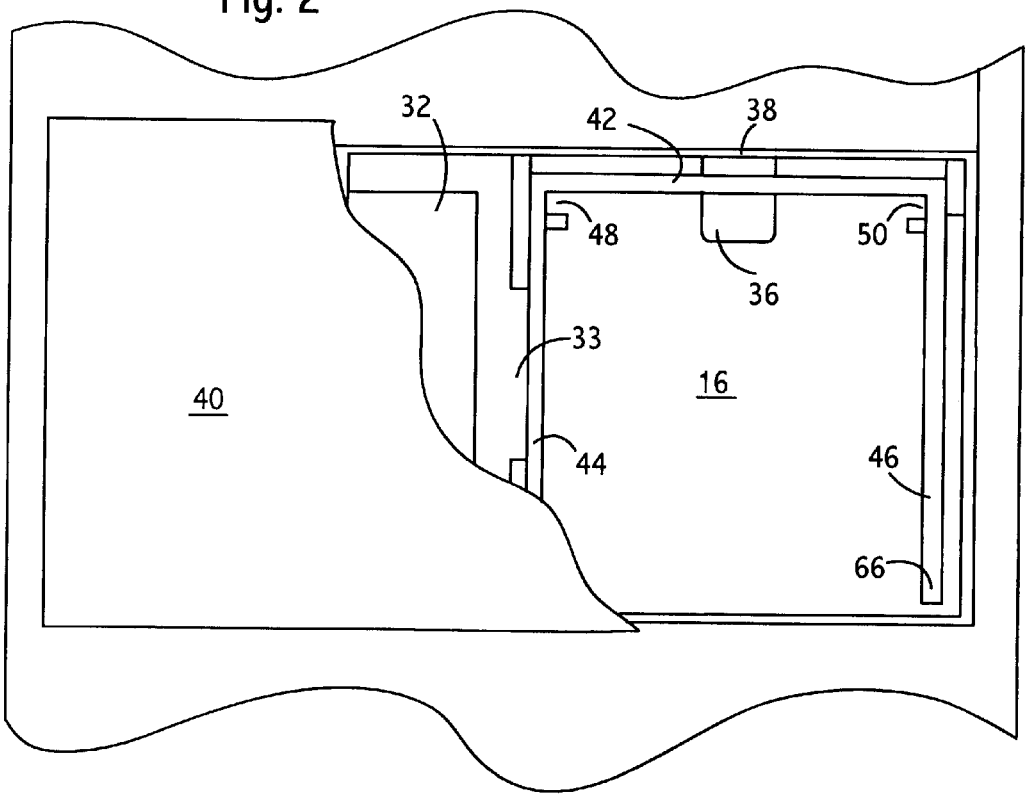
FIG. 2 is a front view of the vacuum cleaner bag mounting assembly with a part of the door cut away and no bag installed.
Figure 3:
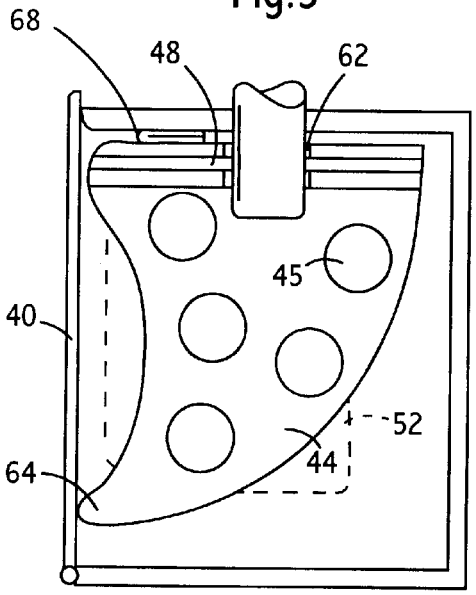
FIG. 3 is sectional side view of the vacuum cleaner bag compartment, with the door closed and the bag in the closed position.
Figure 4:
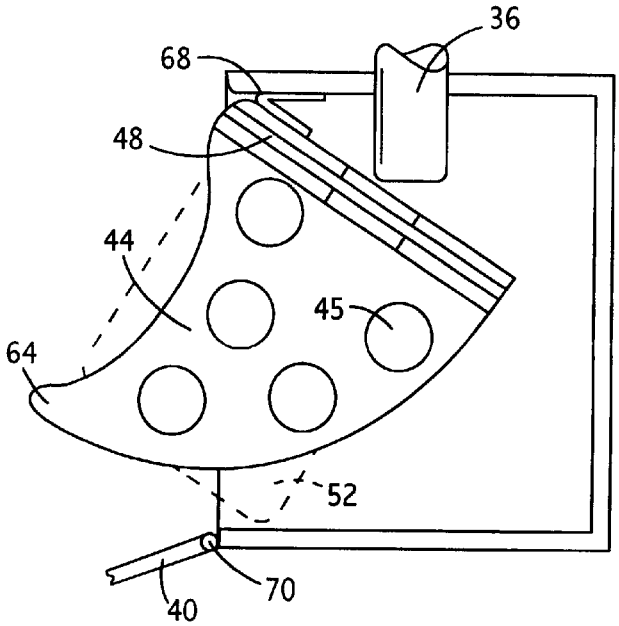
FIG. 4 is a sectional side view of the vacuum cleaner bag compartment, with the door opened and the bag in the open position.
Figure 5:
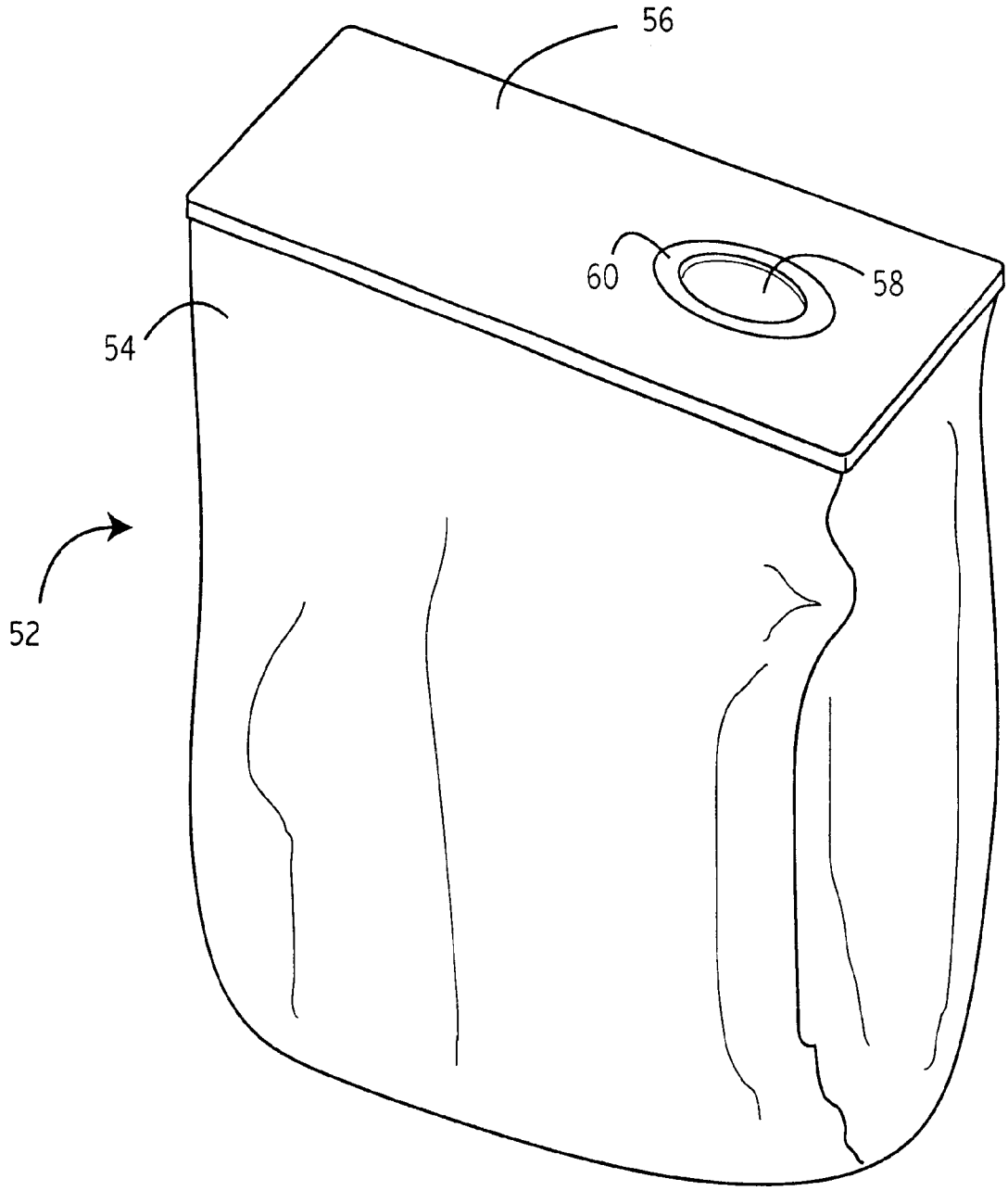
FIG. 5 is a perspective view of a disposable vacuum cleaner bag.

Vacuum bag holder 34, best illustrated in FIGS. 2, 3 and 4, is comprised of a bag attachment wall, shown in the preferred embodiment as upper wall 42, and spaced, parallel bag protector walls, shown in the preferred embodiment as side walls 44 and 46, that extend from the side edges of wall 42. Side walls 44 and 46 may include openings 45 to improve air circulation. The front or outer edge of wall 42 is hinged to the front or outer edge of conduit connector wall 38, permitting wall 42 to pivot between a closed position adjacent and parallel to connector wall 38 when bag holder 34 is in the closed position, and away from connector wall 38 when holder 34 is in the open position. The inner faces of side walls 44 and 46 include bag receiving slots 48 and 50 adjacent and parallel to the lower or inner surface of wall 42.

Bag holder 34 is adapted to receive a disposable debris collector 52 comprised of a open-mouth bag 54 formed of a porous, flexible material, such as paper or a nonwoven fabric, with a cover 56 extending across and sealed to the mouth of bag 54. Cover 56, which may be of cardboard or other disposable material, has parallel side edges, a front edge, and a rear edge, and a conduit receiving opening 58. Opening 58 is surrounded by an annular sealing member 60, which is formed of a flexible, disposable elastomeric material, such as plastic.

Side walls 44 and 46 are spaced at a distance approximately equal to the width of cover 56, and slots 48 and 50, which may be discontinuous slots, have a width approximately equal to the thickness of cover 56. Thus, cover 56 can be slid within slots 48 and 50 to an inserted position beneath upper wall 42. When in the inserted position, conduit receiving opening 58 is aligned with opening 62 in upper wall 42, so that the distal end of conduit 36 can be inserted through openings 62 and 58 into bag 54.

The front edges of side walls 44 and 46 include door engaging projections 64 and 66, respectively, that are adapted to contact the inner face of door 40 when door 40 is moved toward its closed position. Projections 64 and 66 are generally aligned within a plane with the front edges of compartment 16 when door 40 is in a closed position, thereby moving holder 34 to, and restraining holder 34 in, the closed position, when door 40 is pivoted to the closed position.

In order to insert disposable collector 52 into bag holder 34, the user opens door 40, thereby allowing holder 34 to pivot to its open position under the force of spring 68. Collector 52 is then inserted into holder 34 by sliding the side edges of bag cover 56 along slots 48 and 50 until cover 56 is fully inserted beneath upper wall 42, and bag 54 is between side walls 44 and 46.

Door 40 is then pivoted to the closed position, with the inner face of door 40 engaging projections 64 and 66, and pivoting holder 34 to its closed position. As holder 34 is moved to the closed position, upper wall 42 is moved to a parallel position against conduit connector wall 38, pushing openings 58 and 62 around conduit 36, so that annular sealing member 60 forms an airtight seal with the outer surface of conduit 36, and the distal end of conduit 36 projects into bag 54.

When collector 52 is to be removed, the user simply opens door 40, which again moves holder 34 to the open position. As holder 34 pivots to the open position, collector 52 is pulled away from conduit 36. Thus, the user can simply pull full collector 52 from holder 34 and insert a new collector, without the need to reach within compartment 16 to separate collector 52 from conduit 36, thereby reducing the inconvenience of bag changing and the risk of debris spillage.

Figure 6:
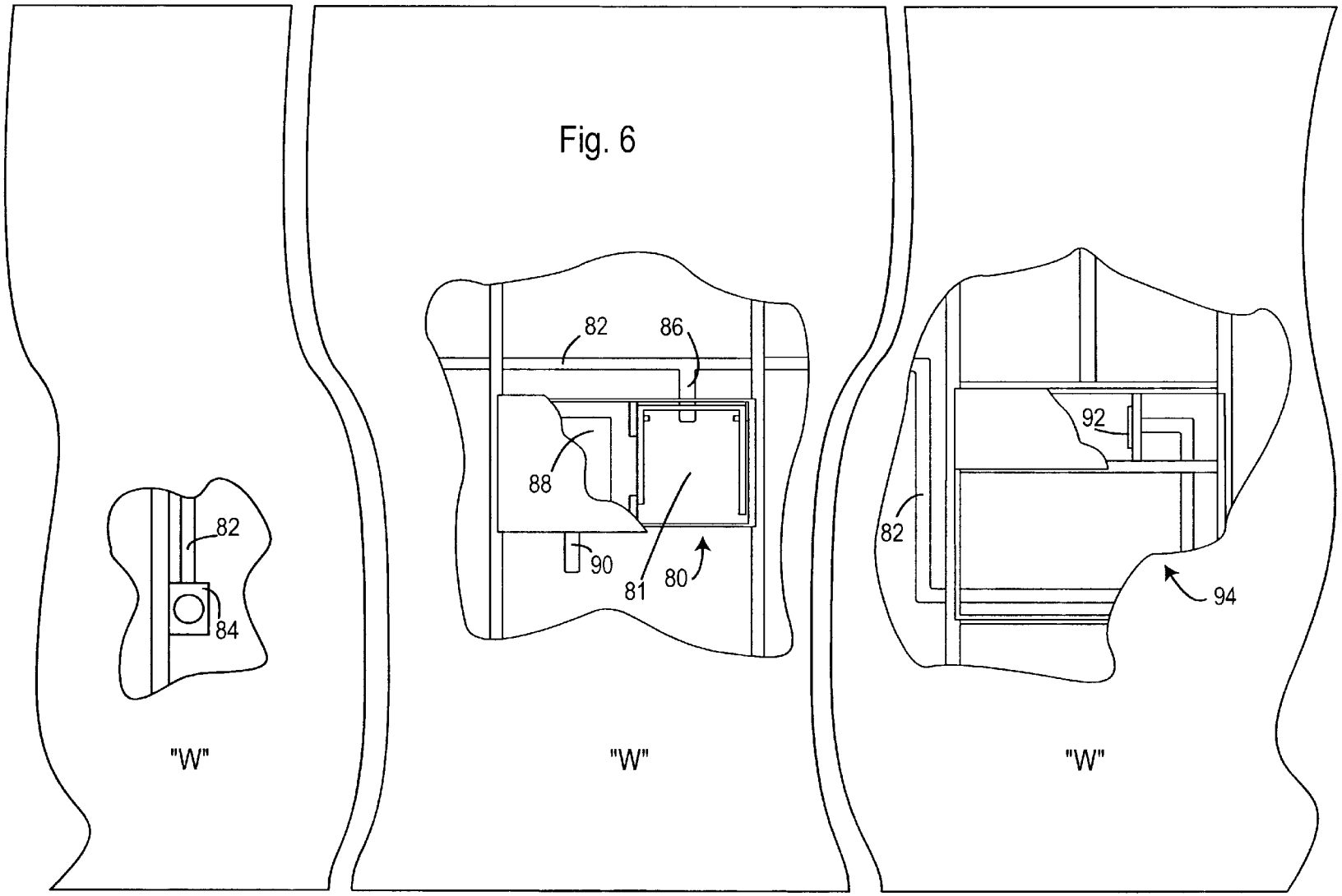
FIG. 6 is a plan view of a wall with the components of the central vacuum system in the wall.

FIG. 6 illustrates an alternative embodiment of the invention of a bag enclosure 81, which is constructed like the enclosure illustrated in FIGS. 2–4, installed in a wall "W" and connected by in-wall conduits 82 to a hose inlet connector 84. As shown, inlet conduit 86 extending into enclosure 81 is in communication with conduit 82, so that air drawn through inlet 82 by vacuum source 88 will be drawn through conduit 82 and into enclosure 81. An exhaust conduit 90 also extends from enclosure 81 to the exterior of the building.

While only segments of conduits 82 and one inlet connector 84 are illustrated, it will be understood that the system will ordinarily include a plurality of interconnected conduits 82 and inlet connector 84. When the term "in-wall" is use herein, it is to be understood that the term is being used to designate that at least a portion of the enclosure or other element is within the building wall. However, a portion of the enclosure or other element may also extend outwardly from the wall.

Figure 7:
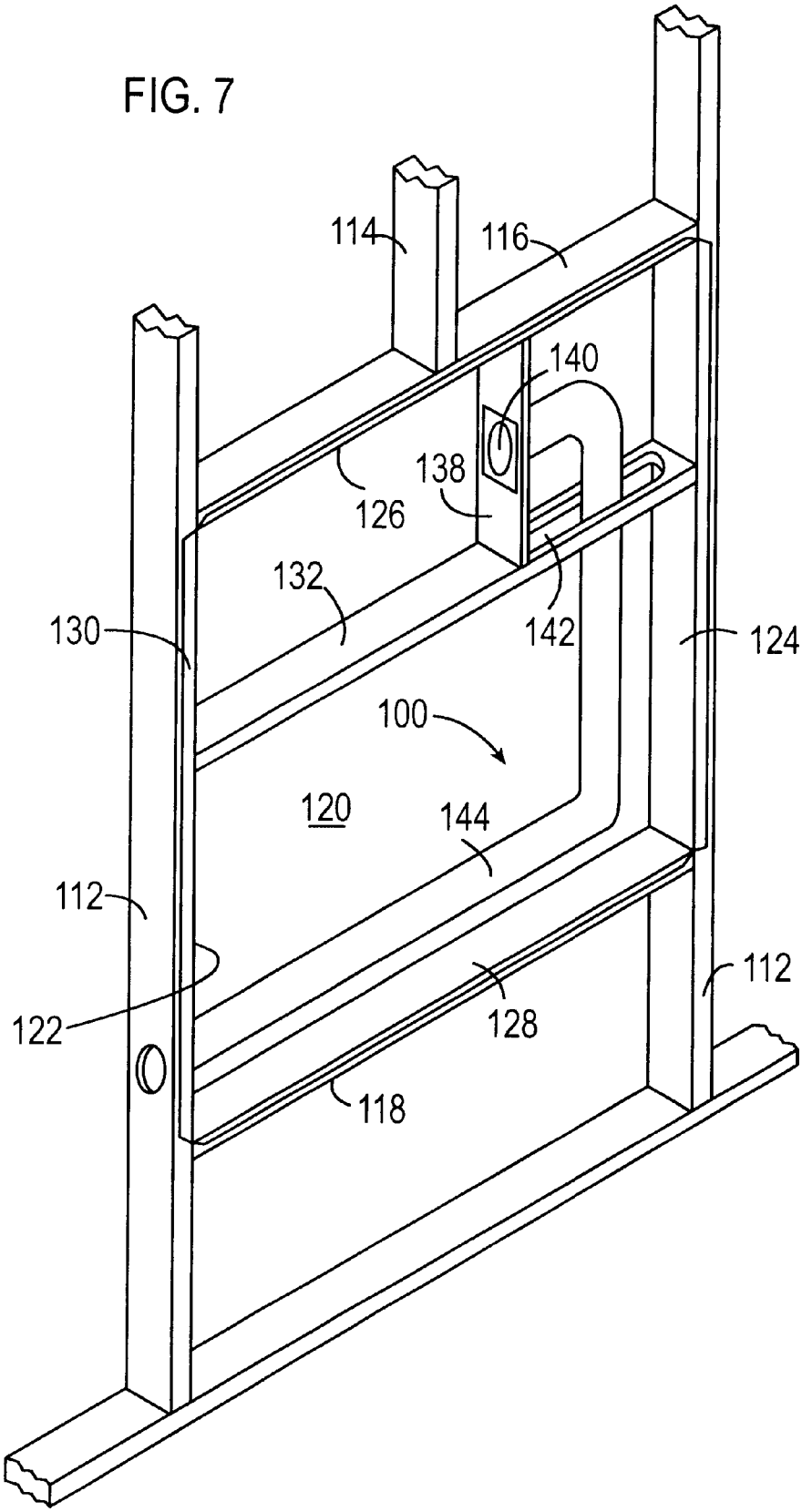
FIG. 7 is a perspective view of an inlet connector enclosure.
Figure 8:
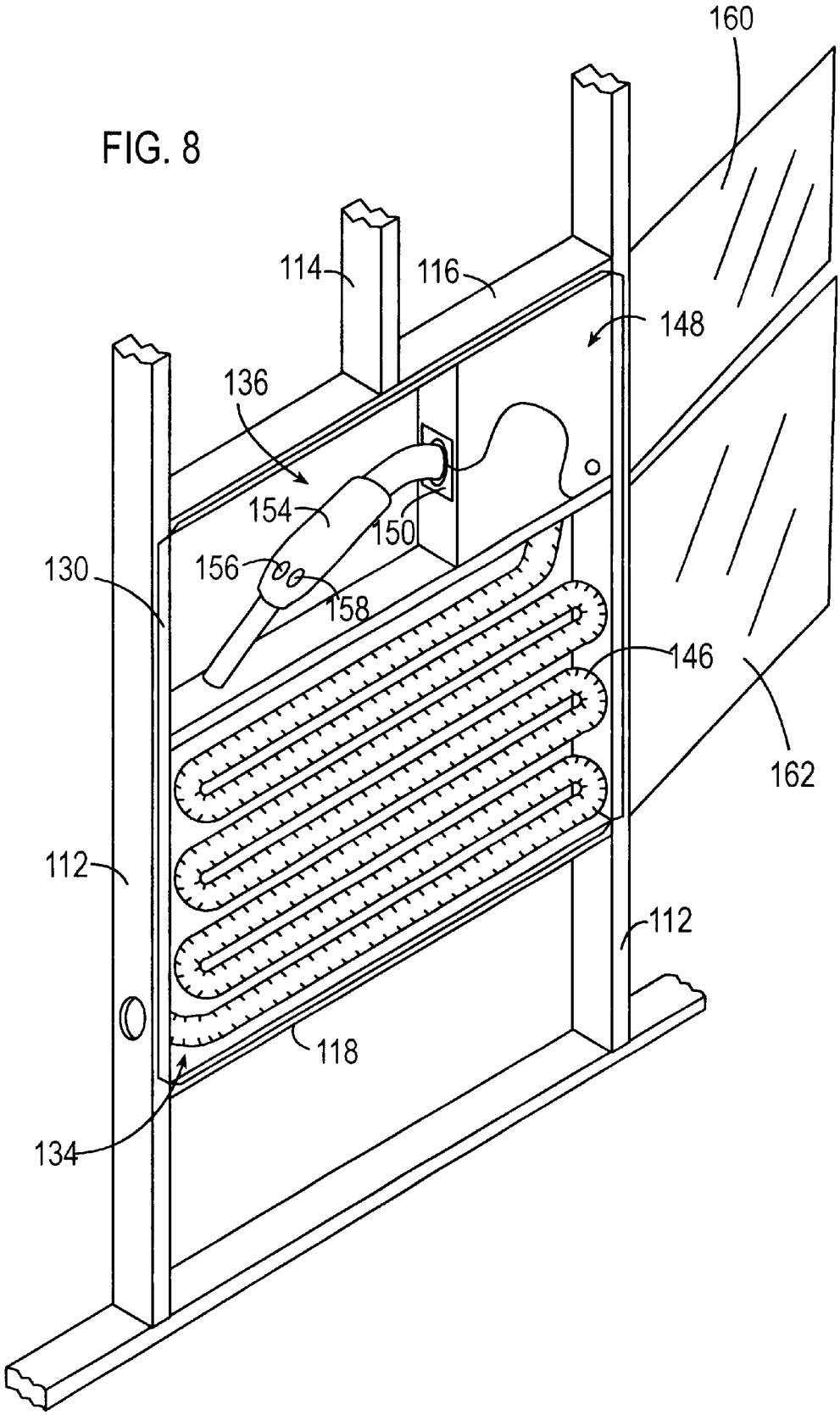
FIG. 8 is a perspective view of an inlet connector enclosure with a stored hose.

Conduit 84 is also connected to another hose inlet connect or 92 that is mounted within recessed enclosure 94. This type of enclosure is shown in greater detail in commonly assigned U.S. Pat. No. 6,427,284, and incorporated herein in its entirety. Generally, as best illustrated in FIGS. 7 and 8, enclosure 94 is comprised of housing 100 installed between adjacent wall studs 112, and beneath intermediate stud section 114, with horizontal cross-bracing member 116 supporting stud section 114. A second horizontal member 118 extends between studs 112 below member 116. Housing 100 includes vertical rear wall 120, side walls 122 and 124, top wall 126 and bottom wall 128. Flanges 130 extend outwardly from the front edges of housing 100 to attach housing 100 to the wall studs.

Horizontal divider 132 extends between the inner faces of the side walls 122 and 124 to divide the interior of housing 100 into a lower hose storage compartment 134 and an upper nozzle/retractor compartment 136 that is separated in the embodiment shown in FIG. 7 into a nozzle side and a connector side by vertical partition wall 138 that extends between the inner face of top wall 126 and the upper surface of divider 132. Partition 138 includes a conventional inlet connector 140 of the type commonly used to connect hoses of central vacuum cleaners.

Divider 132 includes an opening 142 that extends from the connector side of nozzle/retractor compartment 136 into hose compartment 134. Conduit 90 extends from a vacuum bag assembly 80 to housing 100 through a hole in stud 112. Housing 100 includes an opening in side wall 122 to mate with the opening in stud 112. Inlet connector 140 is connected to conduit 90 with connector conduit 144, which extends from inlet connector 140 through opening 142 and hose compartment 134.

Thus, in the embodiment illustrated in FIG. 7, the unit serves basically as a connector for a hose that is stored at a separate location, with the separate hose being connected to inlet connector 140 when used. However, at a later time, the unit can be modified to the configuration shown in FIG. 8 by adding hose 146 and retractor 148, so that hose 146 is stored within the unit instead of at a separate location.

To convert the unit as shown in FIG. 7 to the unit shown in FIG. 8, connector conduit 144 and partition wall 138 with inlet connector 140 are removed, and inlet connector 150, which may be previous connector 140, is installed over the opening in wall 120. The proximal end of flexible hose 146 is inserted from nozzle/retractor compartment 136 through divider 132 and hose compartment 134 to connect to inlet connector 150, and thus to vacuum source 88. Hose 146 extends through reversible hose retractor 152.

In operation, the user grasps nozzle 154 at the distal end of hose 12 and moves switch 156 to its "forward" position to feed hose 146 from hose compartment 134. A second switch 158 may be used to activate vacuum source 88. After vacuuming is completed, vacuum assembly 16 is turned off, and hose 146 is returned to hose compartment 134 by moving switch 156 to the "reverse" position. Door 160 may then be closed to hide nozzle 154 and any attachments stored in the nozzle/retractor compartment. If a malfunction of the hose storage should occur, the unit can be serviced by removing cover 162.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A central vacuum cleaner system comprising:

a) a vacuum cleaner bag mounting assembly including an enclosure with an upper front edge and a lower front edge, a debris collection bag holder having front edges with projections, said bag holder being pivotally mounted to said upper front edge and being pivotal between a closed position within said enclosure and an open position extending outwardly from said enclosure, a spring urging said bag holder to its open position and a door pivotally attached at said lower front edge, said door having an open position allowing access to said bag holder and a closed position that provides an airtight seal, said door having an inner face engaging said holder projections when said door is moved from said open position to said closed position, to move said bag holder from its open position to its closed position and to maintain said holder in the closed position when said door is in its closed position;

b) a hose connection conduit extending into said enclosure, said conduit having a distal end, whereby said distal end is inserted into a bag carried by said bag holder when said bag holder is moved to the closed position;

c) at least one hose inlet connector in communication with said hose connector conduit, said hose inlet connector being located outside said enclosure; and d) a vacuum source in communication with the interior of said enclosure, said vacuum source being adapted to draw air from said inlet connector through said conduit and said enclosure.

2. The system of claim 1, wherein said holder includes a collector attachment wall having an opening through which said conduit extends when said holder is in the closed position, and a bag attachment means for releasibly securing the collection bag to said attachment wall.

3. The system of claim 1, wherein said holder includes sidewalls spaced for insertion of said bag between said side walls.

4. The system of claim 1, wherein said spring is located between said upper front edge of said enclosure and the front edge of said holder for urging said bag holder towards its open position.

5. A central vacuum cleaner system mounted in at least one wall of a building comprising:

a) a vacuum cleaner bag mounting assembly positioned in a wall of a building, said mounting assembly including an open-front enclosure having a conduit connector wall, an upper front edge, a lower front edge, and opposed side edges, a bag holder pivotally mounted at the upper front edge of said enclosure, said holder including a collector attachment wall having an conduit opening, and a bag attachment wall and being pivotal between a closed position within said enclosure and an open position extending outwardly from said enclosure, a spring urging said bag holder to its open position and a door pivotally attached at the lower front edge of said enclosure and having an open position and a closed position, said door engaging said holder when moved from said open position to said closed position, to move said holder from its open position to its closed position, and to maintain said holder in the closed position when said door is in the closed position;

b) a hose connection conduit extending into said enclosure, said hose connection conduit having a distal end, whereby said distal end is inserted into a bag carried by said bag holder when said bag holder is moved to the closed position, and at least one hose inlet connector in communication with said hose connector conduit, said hose inlet connector being located outside said enclosure;

c) an in-wall wall conduit extending within said at least one wall of the building from said inlet connector; and d) a vacuum source in communication with said enclosure, said vacuum source being adapted to draw air from said inlet connector through said in-wall conduit, said hose connection conduit and said enclosure.

6. The system of claim 5, wherein said bag attachment wall includes an inner surface, bag attachment slots beneath said inner surface, and side edges, said holder further including spaced parallel side walls extending from said attachment wall side edges.

7. The system of claim 5, wherein said holder includes front edges with projections, and said door includes an inner face engaging said projections when said door is moved from said open position to said closed position.

8. The system of claim 5, wherein said bag attachment wall is the top wall of said holder, said attachment wall being hinged at the first front edge of said enclosure, and said door being hinged at the second front edge of said enclosure.

9. The system of claim 5, wherein said inlet connector is recessed within a housing mounted in said wall.

10. A central vacuum cleaner system mounted within the wall of a building having an exterior comprising:

a) an enclosure with an upper front edge and a lower front edge, said enclosure mounted within a wall of said building, said enclosure having a front door pivotally attached at the lower front edge of said enclosure and being pivotal between an open position and a closed position;

b) a bag holder including a collector attachment wall having a conduit opening, side walls with front projections, and a bag attachment means for releasibly securing the collection bag to said attachment wall, and being pivotal between a closed position within said enclosure and an open position extending outwardly from said enclosure, a spring urging said holder to its open position and said door having an inner face engaging said front projections when moved from said open position to said closed position, to move said bag holder from its open position to its closed position, and to maintain said holder in the closed position when said door is in the closed position;

c) a hose connection conduit extending into said enclosure, said hose connection conduit having a distal end, whereby said distal end is inserted into a bag carried by said bag holder when said holder is moved to the closed position, and at least one hose inlet connector in communication with said hose connector conduit, said hose inlet connector being located outside said enclosure;

d) an in-wall conduit extending from said inlet connector; and e) a vacuum source in communication with said enclosure, said vacuum source being adapted to draw air from said inlet connector through said in-wall conduit, said hose connection conduit and said enclosure.

11. The system of claim 10, further including an exhaust conduit extending from said enclosure to the exterior of the building.

12. The system of claim 10, further including a recessed housing enclosing said inlet connector and said conduit.

13. The system of claim 12, wherein said recessed hosing has a front cover.

14. The system of claim 12, further including a flexible hose within said recessed housing, said hose having a proximal end attached to the conduit extending from said inlet connector within said housing.

* * * * *